United States Patent [19]

Calman

[11] Patent Number: 4,586,431

[45] Date of Patent: May 6, 1986

[54] METHOD OF SIMULATED ENGRAVED PRINTING

[76] Inventor: Donald R. Calman, 18 Anchor Dr., Rye, N.Y. 10580

[21] Appl. No.: 621,096

[22] Filed: Jun. 15, 1984

[51] Int. Cl.[4] ..... B31F 1/07

[52] U.S. Cl. ..... 101/32; 101/23; 283/1 R

[58] Field of Search ..... 101/32, 3 R, 23; 283/58, 104, 105, 1 R

[56] References Cited

U.S. PATENT DOCUMENTS

| | | | |
|---|---|---|---|
| 1,467,110 | 9/1923 | Irving et al. . | |
| 1,583,861 | 5/1926 | Smith . | |
| 1,744,829 | 1/1930 | Dreyfus . | |
| 1,892,392 | 12/1932 | Grupe | 101/32 X |
| 1,922,248 | 8/1933 | Kelly . | |
| 2,097,005 | 10/1937 | Waters et al. . | |
| 2,390,618 | 12/1945 | Roehm | 101/32 |
| 2,392,594 | 1/1946 | Karfiol et al. | 101/32 X |
| 2,446,471 | 8/1948 | Goike . | |
| 2,603,146 | 7/1952 | Lyon . | |
| 2,681,612 | 6/1954 | Reimann . | |
| 2,734,452 | 2/1956 | Rausch . | |
| 3,252,410 | 5/1966 | Stephenson | 101/32 |
| 3,403,621 | 10/1968 | Simon et al. . | |
| 3,586,834 | 6/1971 | Dykaar et al. | 235/61.12 |
| 3,828,664 | 8/1974 | Dikoff | 101/19 |
| 3,915,090 | 10/1975 | Horst et al. | 101/426 |

FOREIGN PATENT DOCUMENTS

| | | | |
|---|---|---|---|
| 465792 | 9/1928 | Fed. Rep. of Germany | 101/32 |
| 598442 | 2/1948 | United Kingdom | 101/32 |

*Primary Examiner*—Clifford D. Crowder

*Attorney, Agent, or Firm*—Yuter, Rosen & Dainow

[57] ABSTRACT

A paper web is continuously printed with simulated engraving by an embossing die formed with projections for printing a dot matrix or a simple bar projection. In a printing operation, the embossing die acts on the backside of a preprinted web of paper with the embossed dot or bar pattern being in registry with the printed matter. Words are raised from the surface of the web by action of the die without limiting the raised portions precisely to contours of individual characters.

12 Claims, 8 Drawing Figures

10
12
14
16
16
18
20
22
24
24
24
25
27
29
31
40
42
A
A
A

FIG. 2
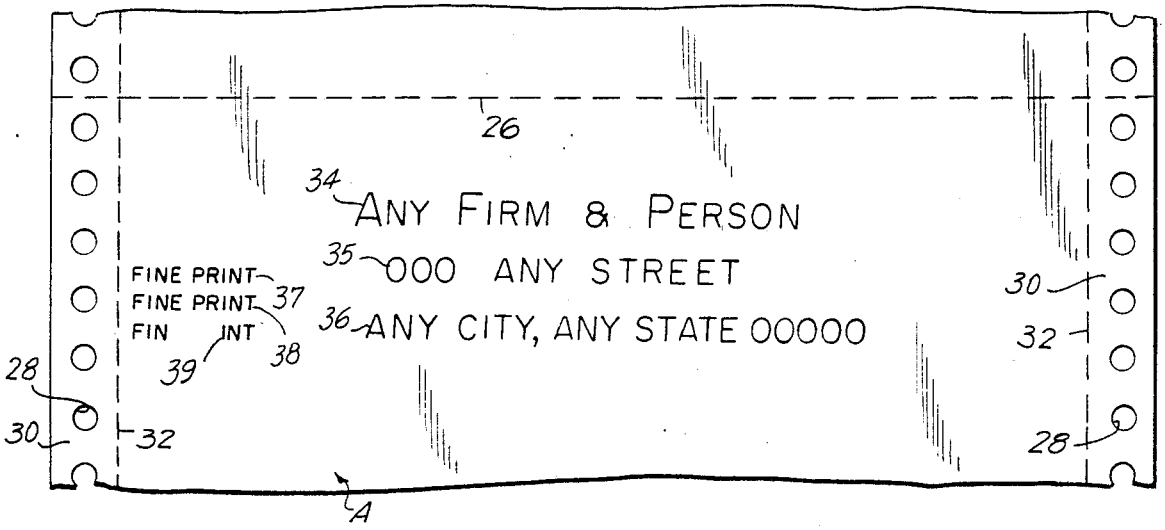
FIG. 4
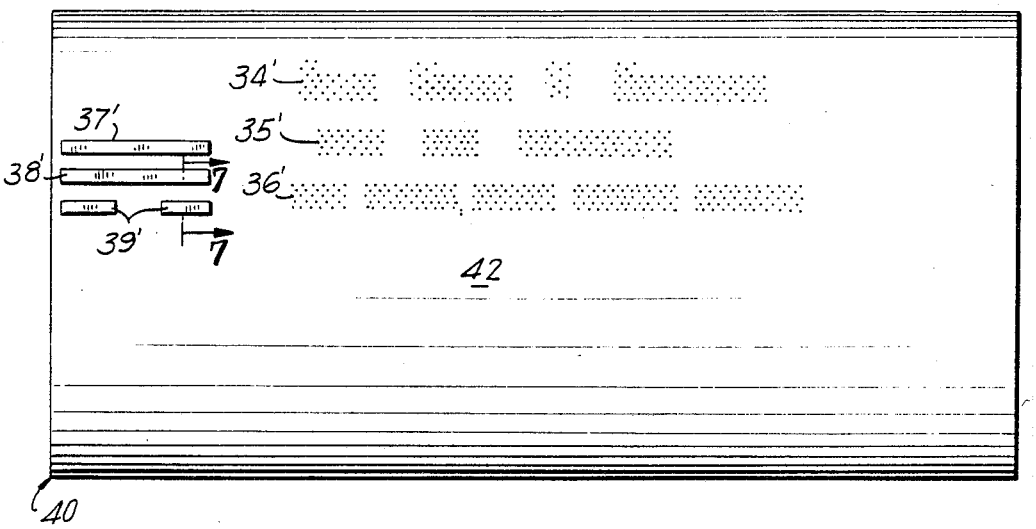
FIG. 5
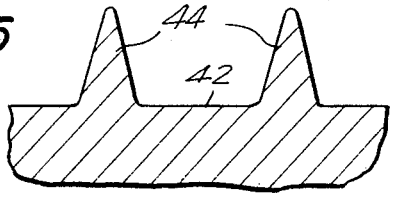
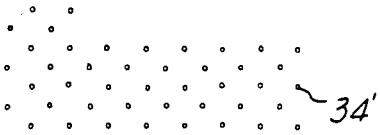
FIG. 6
FIG. 7
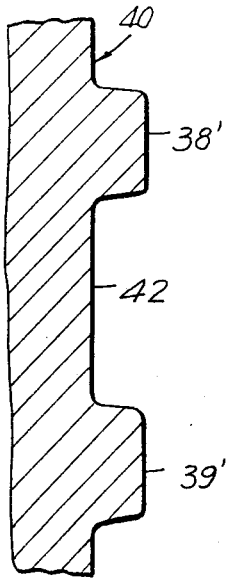

METHOD OF SIMULATED ENGRAVED PRINTING

BACKGROUND OF THE INVENTION

This invention relates generally to printed paper and to a method and apparatus of the type used to print on and emboss a print media so as to simulate engraved printing and more particularly to a method and apparatus for repetitive printing with simulated engraving on a continuously moving web of print media of extended length. With word processing and computer controlled printers making ever-increasing inroads on office procedures for production of printed pages, a conflict arises between the desire of many firms to use high quality stationery in a format including engraved letterheads and the desire to take advantage of the high speed capability of said computer and word processor controlled printers. Such printers are typically fed with paper in the form of a fan-folded continuous web where perforated lines separate consecutive sheets of paper, and sprocket holes are provided on perforated strips outside the conventional margins of the finished printed page for advancing the paper.

To provide such fanfolded webs with preprinted letterheads on every web segment does not present great difficulties. However, it has heretofore not been possible to provide continuous webs of paper having preprinted letterheads which are engraved. Many large and small corporations, law firms, professional people, and the like, require that all company correspondence be on letterhead paper wherein the characters of the letterhead are engraved or at least raised above the paper.

Engraving is a process which is costly and time consuming because each sheet is printed individually. In the well known method, plates are prepared engraved with the characters which are to appear in raised ink on the finished product. The engraved grooves are filled with ink. Excess ink is removed and the sheet to be printed is pressed between the ink filled plate and a backing plate such that the ink from the engraved grooves attaches to the paper. Such a process is not novel. Therefore further description is not included herein. The finished product, using a letterhead as an example, is a sheet of paper having a printed letterhead wherein all letters are raised by the ink thickness above the general planar level of the paper. Additionally, on the reverse side of the paper there are depressions corresponding to each letter which has been printed in engraved format, which depressions result from the high pressure used in pressing the paper against the grooves in the ink filled engraving plate in order to cause the ink to transfer from the plate to the paper.

Thus, a cursory examination of a firm's stationery to ascertain whether engraving has been used on the letterhead involves the steps, consciously or subconsciously, of running one's finger over the print to see whether the ink is raised and running a finger behind the print or inspecting the backside of the paper to see whether a depression exists corresponding with the outlines of the raised ink letters on the opposite face of the paper.

In another less expensive technique for producing letterheads of good quality which resemble engraved printing, the paper is printed and while the ink is wet or moist the characters are powdered with an adhering resin powder or similar material adapted to fuse and set after application of heat. The application of heat causes melting of the resinous compound whereby the particles fuse together on the ink and harden. The fused particles produce a generally raised effect for the characters. This process is known as thermography. As stated, it has the advantage of producing raised ink characters without the expensive sheet by sheet pressing used in the engraving technique. However, although the letters are raised on the front face of the paper, the reverse side of the paper has no impression. Therefore it is no problem for those interested in such matters to determine that the paper and letterhead are in fact not engraved. As stated, for many users, for example, large law firms, such "less-than-the-best" quality is unacceptable.

What is needed is a simple and effective method and apparatus for simulating engraved paper which can be accomplished in a continuous high speed process on a continuous web of paper.

SUMMARY OF THE INVENTION

Generally, in accordance with the invention paper is printed with simulated engraving and, a method and apparatus suitable for simulating engraved printing is provided. An embossing die is formed which contains projections for printing a dot matrix or a simple bar, running parallel to the direction of line printing on the web. In a printing operation, the embossing die acts on the backside of a preprinted web of paper with the embossed dot or bar pattern being in registry with the printed matter. The letters are raised from the surface of the web by action of the die without limiting the raised portions precisely to the contours of the individual letter or letters.

A line of words in small type is raised by embossing with a projecting bar which blankets all of the characters, the bar not defining outlines of individual characters. Individual words in small type are separated by use of individual bars only when word spacing is greater than normal printing would require. But continuous bars may also be used which bridge the gap between printed words.

Characters in words printed in larger type are raised after printing by embossing with a matrix of projecting dots on the die. The height and width of the dot matrix are in conformity with the height and width of the characters in a word. Where different letter heights are used for the same word, the dot pattern is varied to accommodate the letter heights. The dot matrix on the die is discontinuous such that spaces between words of larger type are not raised, and no attempt is made with the dot matrix to register dot matrix to the actual contours of individual printed characters.

Thus, printed characters are raised by simple dies on the front face of the web and a corresponding registered depression is made on the reverse side of the web, similar to the effect produced by engraving techniques. Printing, simulating engraving, can be performed on a high speed basis to produce continuous webs, as now commonly used with computer controlled printers for general office work. In such applications, the printer uses a folded web of pages connected together by perforated lines, wherein each page is preprinted with a letterhead "engraved" by the above described method and apparatus.

Accordingly, it is an object of this invention to provide an improved method and apparatus for producing paper printed with characters resembling characters produced by engraving techniques.

Another object of this invention is to provide an improved method and apparatus for high speed, repetitive printing of a continuous web with copy which resembles printing produced by engraving techniques.

A further object of this invention is to provide an improved method and apparatus for printing with characters which are raised above the surface of the paper, the opposite side of the paper having depressions in general registry with the characters printed on the reverse side.

Still another object of this invention is to provide a low cost method and apparatus for production of paper bearing simulated engraved printing.

Still other objects and advantages of the invention will in part be obvious and will in part be apparent from the specification. The invention accordingly comprises the several steps and the relation of one or more of such steps with respect to each of the others, the apparatus embodying features of construction, combination and arrangement of parts which are adapted to effect such steps, and the article which possesses the characteristics, properties and relations of all elements, all as exemplified in the detailed disclosure hereinafter set forth, and scope of the invention will be indicated in the claims.

BRIEF DESCRIPTION OF THE DRAWINGS

For a fuller understanding of the invention, reference is had to the following description taken in connection with the accompanying drawings, in which:

FIG. 2 is a portion of a continuous web of paper, preprinted with a letterhead and suitable for use with the die of FIG. 4;

FIG. 4 is a face view of an embossing die in accordance with the invention;

FIG. 5 is a side elevational view, to a greatly enlarged scale, of two protrusions on the die of FIG. 4;

FIG. 6 is a face view, to an enlarged scale, illustrating the matrix pattern of dot protrusions on the die of FIG. 4;

FIG. 7 is a sectional view taken along the line 7—7 of FIG. 4;

DESCRIPTION OF THE PREFERRED EMBODIMENTS

The method of simulating engraved printing in accordance with the invention can be implemented for printing of a continuous web of paper, for example, fan folded paper as used in printers driven by word processors and computers. The invention can also be applied to conventional techniques for printing single sheets of paper. For the sake of an example, the method and apparatus in accordance with the invention are described herein as applied with an offset printing apparatus.

Figures 1, 3:
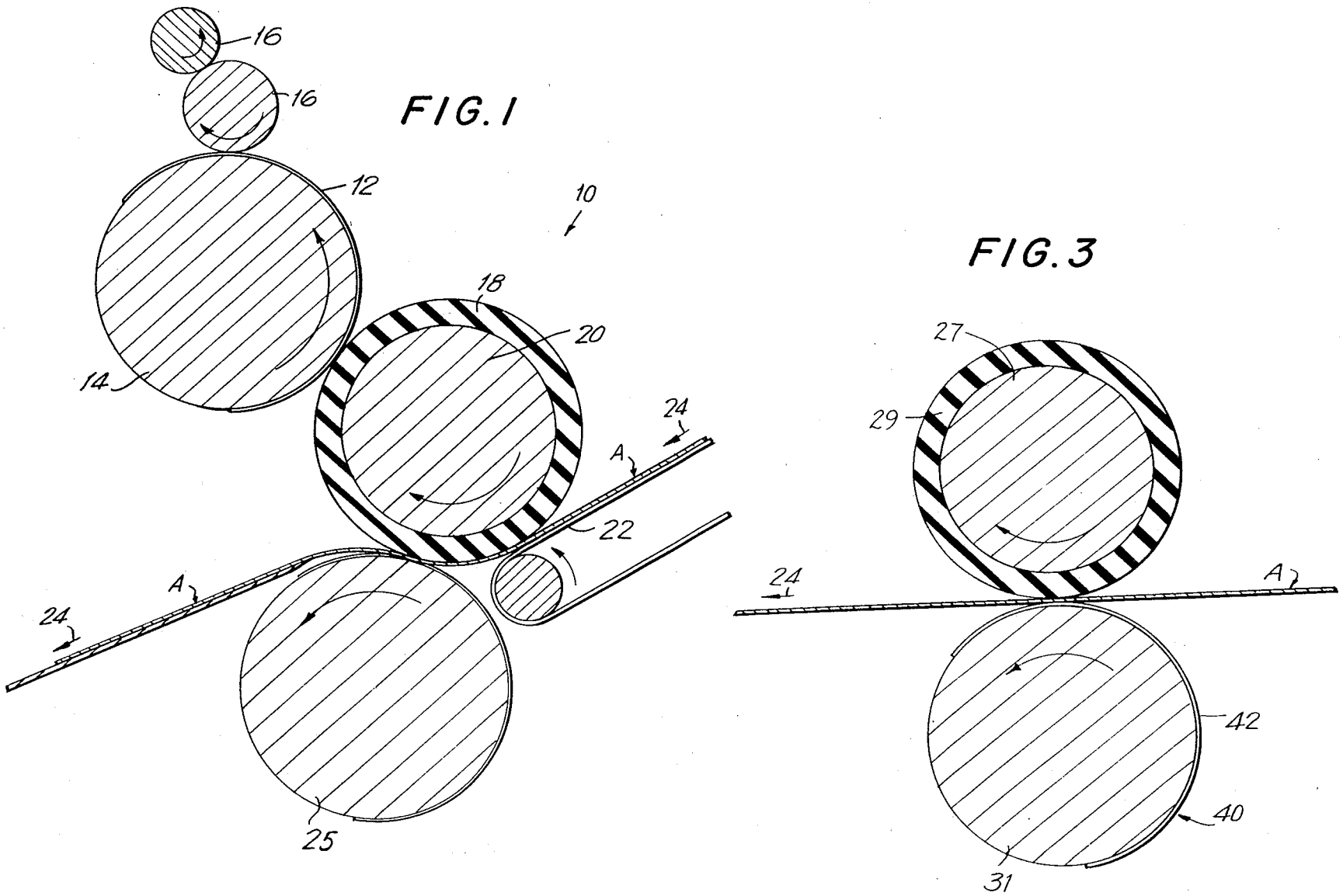
FIG. 1 is a schematic view, not to scale, of an offset printing press.
FIG. 3 is an embossing die and opposed roller in accordance with the invention.

As illustrated in FIG. 1, a transfer sheet 12 containing the desired copy in the form of words and numerals, for example, is prepared and fastened onto a plate roll 14. Printing ink which has been applied to inking roll 16 is transferred to the sheet 12 by rolling contact therewith. Only the portions of the transfer sheet 12 corresponding to the copy thereon are coated with ink from the inking roll 16. The plate roll 14 rotates in contact with the surface of a resilient rubber blanket 18 which forms the peripheral surface of a blanket cylinder 20. Ink from the transfer sheet 12 is transferred by rolling contact to the surface of the resilient blanket 18.

A web of paper A is continuously fed along a conveyer 22 in the direction of arrows 24 to pass between the blanket cylinder 20 and a solid roll 25. The resilient blanket 18 and roll 25 rotate as indicated by the arrows as the paper web A is moved therebetween. The ink on the resilient blanket 18 is transferrred to the surface of the paper web A, and the web A passes to a take-up drum (not shown) or immediately to an embossing stage as described hereinafter.

Thus, the continuous web A has the copy, in the form of a letterhead, for example, printed at periodic intervals on the continuous web of paper A.

FIG. 2 illustrates a portion of a continuous web A which is constructed for use in a computer or word processor controlled printer. The web A has a line 26 of perforations which allows transverse separation of the web A into individual sheets of paper. The side margins of the web A include sprocket holes 28 positioned along marginal strips 30 separated from the main body of the preprinted sheet by perforations 32.

The illustrated copy, purely exemplary, is a combination of words and numerals comprising groups of characters. The type is illustrated in three heights. The first line 34 of type illustrates all upper case letters. However, the initial letter of each word and the single character between the second and third words are of a height greater than the height of the remaining characters on line 34. The characters on line 35 are all of the same height, which height is the same as the height of those characters other than the initial characters on line 34. The characters in line 36 are the same height as the characters in line 35. The fine-print characters in lines 37–39 are of equal height. However, the character height in lines 37–39 is less than the character height in any of lines 34–36. The type style which is used in printing the letterhead is unimportant in the context of this invention.

The web A, printed on one side in ink with the desired copy or printed matter, now passes (FIG. 3) between a roller 27 having a resilient layer or coating 29 thereon and an embossing roller 31 having an embossing die 40 affixed to the outer circumferental surface thereof. As the roller 27 and embossing roller 31 rotate as indicated by the arrows, raised patterns on the embossing die 40 are pressed into the resilient layer 29. The web A moves continuously from the offset printing apparatus of FIG. 1 to the apparatus illustrated in FIG. 3, or if the preprinted web is stored on a take-up drum, the web A is fed from the take-up drum (not shown) to the apparatus for embossing of FIG. 3. The raised pattern on the die embosses the printed matter from below such that the ink printed characters are raised above the generally planar surface of the web A and an impression is left on the underside of the web A in registry with the raised groups of characters.

The die 40 is fabricated of a rigid material, as compared to the resilience of the layer 29, for example, metal or plastic.

FIG. 4 illustrates a surface of the embossing die 40 having raised portions thereon. The raised portions are in patterns which correspond with the groups of characters on the preprinted web A. Thus, there are patterns in a line 34' which correspond in relative position, height, width and orientation to the print on line 34 of FIG. 2. Also, patterns in lines 35'–39' correspond with the character groups 35–39 of FIG. 2. The patterns 37'–39', corresponding to the fine print 37–39 of FIG. 2, are horizontal bars raised above the surface 42 of the embossing die 40. As illustrated, the bars can be continuous 37', 38' or separated as at line 39' to correspond with the spacing between the printed words in corresponding lines 37–39 of FIG. 2. As illustrated, the bar 39' is discontinuous because the large space between words on line 39 of the preprinted sheet (FIG. 2) is many times the width of the printed characters. The decision whether to divide the bar 39' into two segments, as illustrated, or to maintain a single bar as in lines 37', 38' is left to the discretion of the printer and the customer requirements with regard to the appearance and feel of the fine print.

With regard to words formulated of large characters, as illustrated in lines 34–36, patterns 34'–36' are formed on the embossing die 40 with space provided between each group of characters comprising a word or numeral. The patterns are made up of a matrix of projections 44 rising from the surface 42 of the embossing die 40 (FIG. 5). The projections 44 are generally conical and having rounded tips such that when pressed into the backside of the sheet of paper A and embedded into the resilient layer 29, the effect on the backside appears as a series of dots or pin pricks, although no perforation of the paper is produced. The projections 44 are spaced apart in a regular pattern, for example, as illustrated in FIG. 6. It should be noted that the pattern increases in height in correspondence with the height of the printed characters. Thus, the height of the matrix pattern for the initial letter of the word on line 34 (FIG. 2) is higher than the matrix pattern for the remaining letters in the word.

It should be readily understood, that the embossing die 40 is prepared with spaced patterns of bars and matrices such that as each pattern on the die 40 comes into the position of tangency with the resilient layer 29, there is registry between the preprinted copy on the sheet A and the correspondingly rasied portions of the die surface 42.

Figure 8:
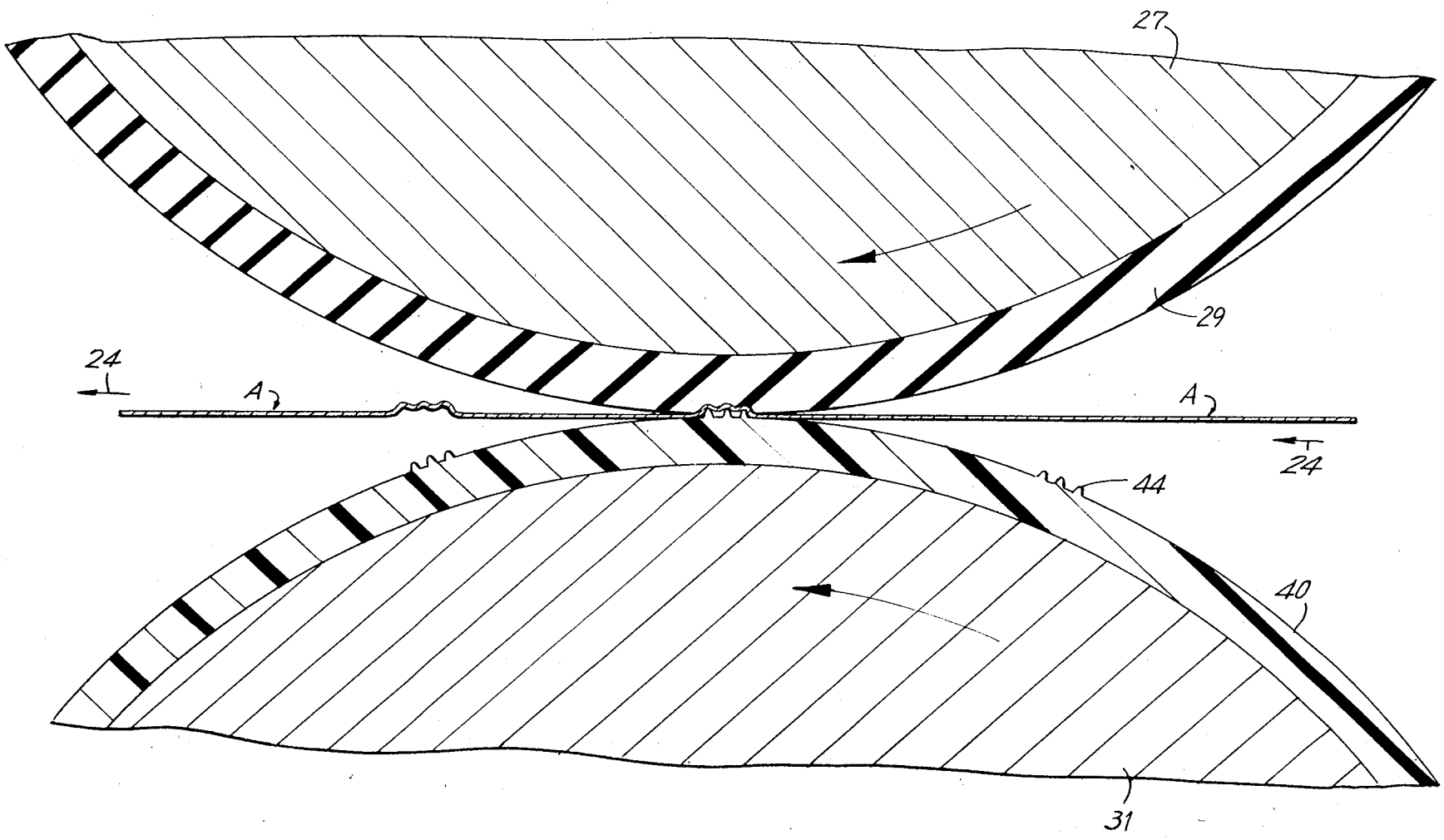
FIG. 8 is a partial side sectional view to an enlarged scale illustrating the process of embossing a web with a die as in FIG. 3.

FIG. 8 illustrates the condition where a raised pattern of protrusions 44 on the die 40 is impressed into the layer 29, upwardly, locally, and permanently deforming the paper web A.

The means for maintaining registry between the preprinted web A and the raised surfaces of the die 40 are conventional, not a novel portion of this invention and accordingly are not described in detail herein. Good registry enhances the finished product but high precision is not a necessity.

It should be understood, that although the Figures illustrate a matrix comprised of dots produced by generally conical projections 44 from the die surface 42, the projections need not be such as to produce a dot pattern. Many different patterns may be used with the projections in various forms, for example, diamonds, hollow circles, triangles, asterisks, squares, and the like. Also, it is not necessary that the protrusions be in a regularly distributed matrix as illustrated in FIG. 6, but may have a generally random pattern so long as the pattern of projections falls generally within the boundaries of the word groups which are to be embossed on the finished sheet A. Satisfactory simulated engraved printing has been provided wherein the patterns, that is the matrix patterns 34'–36' and the bar patterns 37'–39' lie within the boundaries of the printed words and numerals when the die and preprinted copy are in registry.

It should also be understood, that in alternative embodiments in accordance with the invention, single paper sheets may be printed one-at-a-time and later embossed one-at-a-time, or a continuous web may be preprinted with ink, cut into single sheets and then embossed one-at-a-time. Any known technique for printing and embossing may be adapted for use with dies in accordance with the invention and fall within the scope thereof.

It will thus be seen that the objects set forth above, among those made apparent from the preceeding description, are efficiently attained and, since certain changes may be made in carrying out the above process, in the described product, and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

What is claimed is:

1. A method for simulating engraved printing on a print media comprising the steps:

a. printing at least one character with ink on a first side of said print media, said at least one character being in at least one group forming at least one word, and said characters being arranged in at least one line of print;

b. elevating portions of a first surface of a die in at least one pattern corresponding in size and shape of its peripheral outline to the peripheral outline of said at least one group taken as an entity, said at least one pattern being one of a group consisting of a solid bar and a matrix of a plurality of protrusions extending from said first surface, said protrusions being shaped and distributed within said pattern without regard to actual shape of any one of said at least one character within said at least one group;

c. positioning momentarily said ink-printed media between said first surface and a second surface, said second surface having resilience, said at least one printed group of characters facing said second surface;

d. registering at least momentarily each said ink printed group with the corresponding elevated pattern on said second surface;

e. pressing said first and second surfaces together causing said elevated patterns in said print media to press into said second surface during said registry with said corresponding printed groups;

f. separating said registered groups of characters and patterns on said first surface and print media, respectively.

2. A method as claimed in claim 1 and further comprising the steps:

g. feeding said print media continuously between said first and second surface;

h. repeating steps a and c–f periodically during said feeding period.

3. A method as claimed in claim 1, wherein said groups also include characters forming numerals.

4. A method as claimed in claim 1, wherein the peripheral outlines of said patterns, when registered with said corresponding groups of printed characters fit within the peripheral outlines of said corresponding groups of characters.

5. A method as claimed in claim 1, wherein said matrix of protrusions impresses a dotted pattern into the back surface of said corresponding preprinted group of characters.

6. A method as claimed in claim 1, wherein there is a plurality of patterns and at least some of said patterns have separations of lower level therebetween corresponding to spaces between said groups of characters.

7. A method as claimed in claim 6, wherein said matrix of protrusions impresses a dotted pattern into the back surface of said print media.

8. A method for simulating engraved printing on a print media comprising the steps:

a. printing at least one character with ink on a first side of said print media, said at least one character being in at least one group forming at least one word;

b. elevating portions of a first surface of a die in at least one pattern corresponding in size and shape of its peripheral outline to the peripheral outline of said at least one group taken as an entry, said at least one pattern being one of a group consisting of a solid bar and a matrix of a plurality of protrusions extending from said first surface, said protrusions being shaped and distributed within said pattern without regard to actual shape of any one of said at least one character within said at least one group;

c. positioning momentarily said ink-printed media between said first surface and a second surface, said second surface having resilience, said at least one printed group of characters facing said second surface;

d. registering at least momentarily each said ink printed group with the corresponding elevated pattern on said second surface;

e. pressing said first and second surfaces together causing said elevated patterns in said print media to press into said second surface during said registry with said corresponding printed groups;

f. separating said registered groups of characters and patterns on said first surface and print media, respectively.

9. A method as claimed in claim 8 and further comprising the steps:

g. feeding said print media continuously between said first and second surface;

h. repeating steps a and c–f periodically during said feeding period.

10. A method as claimed in claim 8, wherein said groups also include characters forming numerals.

11. A method as claimed in claim 8, wherein the peripheral outlines of said patterns, when registered with said corresponding groups of printed characters fit within the peripheral outlines of said corresponding groups of characters.

12. A method as claimed in claim 8, wherein said matrix of protrusions impresses a dotted pattern into the back surface of said corresponding preprinted group of characters.

* * * * *

UNITED STATES PATENT AND TRADEMARK OFFICE

CERTIFICATE OF CORRECTION

PATENT NO. : 4,586,431

DATED : May 6, 1986

INVENTOR(S) : Donald R. Calman

It is certified that error appears in the above-identified patent and that said Letters Patent is hereby corrected as shown below:

Column 6, Claim 1, line 55, "second" should read -- first --.

Column 6, Claim 1, line 52, "in" should read -- and --.

Column 6, Claim 1, lines 61-62, delete ", respectively --.

Column 6, Claim 2, line 68, delete "period".

Column 7, Claim 8, line 31, "entry" should read -- entity --.

Column 8, Claim 8, line 10, "second" should read -- first --.

Column 8, Claim 8, line 12, "in" should read -- and --.

Column 8, Claim 8, lines 16-17, delete ", respectively --.

Column 8, Claim 9, line 23, delete "period".

Signed and Sealed this

Ninth Day of December, 1986

*Attest:*

DONALD J. QUIGG

*Attesting Officer*

*Commissioner of Patents and Trademarks*